US008168005B2

(12) United States Patent
Borne

(10) Patent No.: US 8,168,005 B2
(45) Date of Patent: May 1, 2012

(54) LIQUID DETERGENT COMPOSITION FOR IMPROVED GREASE CLEANING COMPRISING AN ALKOXYLATED POLYETHYLENEIMINE POLYMER

(75) Inventor: Johanna Borne, Lund (SE)

(73) Assignee: The Procter & Gamble Company, Cincinnati, OH (US)

( * ) Notice: Subject to any disclaimer, the term of this patent is extended or adjusted under 35 U.S.C. 154(b) by 253 days.

(21) Appl. No.: 12/164,769

(22) Filed: Jun. 30, 2008

(65) Prior Publication Data

US 2009/0014029 A1 Jan. 15, 2009

(30) Foreign Application Priority Data

Jul. 11, 2007 (EP) ..... 07112210

(51) Int. Cl.

| | |
|---|---|
| ***B08B 3/04*** | (2006.01) |
| ***C11D 3/37*** | (2006.01) |
| ***C11D 1/12*** | (2006.01) |
| ***C11D 1/75*** | (2006.01) |
| ***C11D 3/30*** | (2006.01) |

(52) U.S. Cl. ..... 134/25.2; 134/25.3; 510/360; 510/421; 510/426; 510/433; 510/475; 510/503

(58) Field of Classification Search ..... 510/360, 510/421, 426, 433, 475, 503; 134/25.2, 25.3
See application file for complete search history.

(56) References Cited

U.S. PATENT DOCUMENTS

| | | | | |
|---|---|---|---|---|
| 3,915,903 | A | 10/1975 | Wise | |
| 5,798,505 | A | 8/1998 | Lee | |
| 5,866,529 | A | 2/1999 | Erilli | |
| 6,008,181 | A | 12/1999 | Cripe | |
| 6,020,303 | A | 2/2000 | Cripe | |
| 6,060,443 | A | 5/2000 | Cripe | |
| 6,075,000 | A * | 6/2000 | Rohrbaugh et al. | 510/299 |
| 6,380,150 | B1 | 4/2002 | Toussaint | |
| 2006/0234898 | A1 * | 10/2006 | Schneiderman et al. | 510/424 |

FOREIGN PATENT DOCUMENTS

| | | | |
|---|---|---|---|
| WO | WO 99/05082 | | 2/1999 |
| WO | WO 99/05084 | | 2/1999 |
| WO | WO 99/05241 | | 2/1999 |
| WO | WO 99/05242 | | 2/1999 |
| WO | WO 99/05243 | | 2/1999 |
| WO | WO 99/05244 | | 2/1999 |
| WO | WO 99/07656 | | 2/1999 |
| WO | WO 00/23548 | | 4/2000 |
| WO | WO 11/23549 | | 4/2000 |
| WO | WO 2004/113484 | A1 | 12/2004 |
| WO | WO 2005/010138 | A1 | 2/2005 |
| WO | WO 2005/049776 | A1 | 6/2005 |
| WO | WO 2006/108857 | * | 10/2006 |
| WO | WO 2007/049249 | A1 | 5/2007 |

OTHER PUBLICATIONS

PCT International Search Report Dated Dec. 18, 2008—7 pgs.

* cited by examiner

*Primary Examiner* — Brian P Mruk

(74) *Attorney, Agent, or Firm* — John T. Dipre; David V. Upite; Steven W. Miller

(57) ABSTRACT

A stable liquid detergent composition having a pH comprised between 7.5 and 8.4 and comprising an alkyl ethoxy sulfate surfactant, an amine oxide surfactant and a polyethyleneimine polymer to provide improved grease cleaning and sudsing and to reduce solution slipperiness.

14 Claims, No Drawings

LIQUID DETERGENT COMPOSITION FOR IMPROVED GREASE CLEANING COMPRISING AN ALKOXYLATED POLYETHYLENEIMINE POLYMER

FIELD OF INVENTION

The present invention relates to a stable neutral pH liquid detergent composition comprising an amine oxide surfactant, an alkyl ethoxy sulfate surfactant and an alkoxylated polyethyleneimine polymer to provide excellent ease cleaning and sudsing as well as to reduce solution slipperiness.

BACKGROUND OF THE INVENTION

Grease cleaning with liquid detergents poses an ongoing problem for consumers. Consumers utilizing liquid detergent as a light-duty liquid dishwashing detergent composition tend to wash greasy, difficult to clean items at the end of their washing experience, after easier to clean items such as glasses and flatware are cleaned. Light-duty liquid dishwashing detergent compositions require a high suds profile while providing grease cleaning. The combination of an amine oxide surfactant and an alkyl ethoxylated sulfate surfactant with an ethoxylation degree ≦2 has been proven to provide excellent grease cleaning as well as sudsing. In order to reduce the solution slipperiness of those compositions, the pH of the composition (measured in a 10% dilution) should be lowered to 7.5-8.4. It has been surprisingly found that the instability caused by such lower pH can be solved by the addition of an alkoxylated polyethyleneimine polymer.

SUMMARY OF THE INVENTION

The present application relates to a liquid detergent composition having a pH at 10% solution comprised between 7.5 and 8.4, comprising (a) from 0.01% to 10% by weight of the composition of an alkoxylated polyethyleneimine polymer comprising a polyethyleneiminie backbone having from 400 to 10000 weight average molecular weight and the alkoxylated polyethyleneiminie polymer further comprises: (1) one or two alkoxylation modifications per nitrogen atom by a polyalkoxylene chain having an average of 1 to 30 alkoxy moieties per modification, wherein the terminal alkoxy moiety of the alkoxylation modification is capped with hydrogen, a $C_1$-$C_4$ alkyl or mixtures thereof, (2) a substitution of one $C_1$-$C_4$ alkyl moiety and one or two alkoxyl about 40 alkoxy moieties per modification wherein the terminal alkoxy moiety is capped with hydrogen, a $C_1$-$C_4$ alkyl or mixtures thereof, or (3) a combination thereof;

b) from 0.1% to 15% by weigt of the composition of an amine oxide surfactant; and c) from 5% to 40% by weight of the composition of an alkyl sulfate surfactant selected from the group consisting of at least an alkyl ethoxylated sulfate surfactant, potentially an alkyl sulfate surfactant, and mixtures thereof; wherein the overall average ethoxylation degree for these alkyl sulfate surfactants is below or equal to 2.

DETAILED DESCRIPTION OF THE INVENTION

The liquid detergent compositions of the present invention are surprisingly stable despite the lower pH of from 7.5 to 8.4 measured at a 10% dilution. They provide excellent cleaning and suds profile in a liquid dishwashing detergent composition and reduced solution slipperiness.

As used herein "grease" means materials comprising at least in part (i.e., at least 0.5 wt % by weight of the grease) saturated and unsaturated fats and oils, preferably oils and fats derived from animal sources such as beef and/or chicken.

As used herein "suds profile" means amount of sudsing (high or low) and the persistence of sudsing (sustained or prevention) throughout the washing process resulting from the use of the liquid detergent composition of the present composition. Liquid dishwashing detergent compositions require high sudsing and sustained suds. This is particularly important with respect to liquid dishwashing detergent compositions as the consumer uses high sudsing as an indicator of the performance of the detergent composition. Moreover, the consumer in a liquid dishwashing detergent composition also uses the sudsing profile as an indicator that the wash solution still contains active detergent ingredients. The consumer usually renews the wash solution when the sudsing subsides. Thus, a low sudsing liquid dishwashing detergent composition formulation will tend to be replaced by the consumer more frequently than is necessary because of the low sudsing level.

As used herein "dish" means a surface such as dishes, glasses, pots, pans, baking dishes and flatware made from ceramic, china, metal, glass, plastic (polyethylene, polypropylene, polystyrene, etc.) and wood.

As used herein "light-duty liquid dishwashing detergent composition" refers to those compositions that are employed in manual (i.e. hand) dishwashing. Such compositions are generally high sudsing or foaming in nature.

As used herein "solution slipperiness" means the feel of the solution on the hand or fingers, often referred to as a "soapy feel", especially noticeable when pHs become alkali.

1) Alkoxylated Polyethyleneimine Polymer

The present composition will comprise from 0.01 wt % to 10%, preferavly from 0.1 wt % to 5 wt %, more preferable from 0.1% to 2% and even more preferably from 0.2% to 1.5% by weight of the composition of an alkoxylated polyethyleneimine polymer.

The alkoxylated polyethyleneimine polymer of the present composition has a polyethyleneimine backbone having from 400 to 10000 weight average molecular weight, preferably from 400 to 7000 weight average molecular weight, alternatively from 3000 to 7000 weight average molecular weight.

The alkoxylation of the polyethyleneimine backbone includes: (1) one or two alkoxylation modifications per nitrogen atom, dependent on whether the modification occurs at a internal nitrogen atom or at an terminal nitrogen atom, in the polyethyleneimine backbone, the alkoxylation modification consisting of the replacement of a hydrogen atom on a polyalkoxylene chain having an average of about 1 to about 40 alkoxy moieties per modification, wherein the terminal alkoxy moiety of the alkoxylation modification is capped with hydrogen, a $C_1$-$C_4$ alkyl or mixtures thereof; (2) a substitution of one $C_1$-$C_4$ alkyl moiety and one or two alkoxylation modifications per nitrogen atom, dependent on whether the substitution occurs at a internal nitrogen atom or at an terminal nitrogen atom, in the polyethyleneimine backbone, the alkoxylation modification consisting of the replacement of a hydrogen atom by a polyalkoxylene chain having an average of about 1 to about 40 alkoxy moieties per modification wherein the terminal alkoxy moiety is capped with hydrogen, a $C_1$-$C_4$ alkyl or mixtures thereof, or (3) a combination thereof.

For example, but not limited to, below is shown possible modifications to terminal nitrogen atoms in the polyethyleneimine backbone where R represents an ethylene spacer and E represents a $C_1$-$C_4$ alkyl moiety and $X^-$ represents a suitable water soluble counterion.

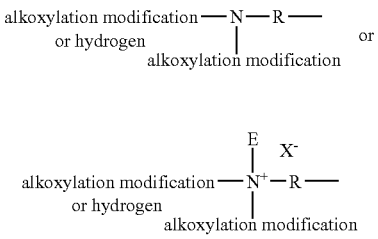

Also, for example, but not limited to, below is shown possible modifications to internal nitrogen atoms in the polyethyleneimine backbone where R represents an ethylene spacer and E represents a $C_1$-$C_4$ alkyl moiety and X— represents a suitable water soluble counterion.

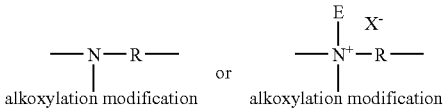

The alkoxylation modification of the polyethyleneimine backbone consists of the replacement of a hydrogen atom by a polyalkoxylene chain having an average of about 1 to about 30 alkoxy moieties, preferably from about 5 to about 20 alkoxy moieties. The alkoxy moieties are selected from ethoxy (EO), 1,2-propoxy (1,2-PO), 1,3-propoxy (1,3-PO), butoxy (BO), and combinations thereof. Preferably, the polyalkoxylene chain is selected from ethoxy moieties and ethoxy/propoxy block moieties. More preferably, the polyalkoxylene chain is ethoxy moieties in an average degree of from about 5 to about 15 and the polyalkoxylene chain is ethoxy/propoxy block moieties having an average degree of ethoxylation from about 5 to about 15 and an average degree of propoxylation from about 1 to about 16. Most preferable the polyalkoxylene chain is the ethoxy/propoxy block moieties wherein the propoxy moiety block is the terminal alkoxy moiety block.

The modification may result in permanent quaternization of the polyethyleneimine backbone nitrogen atoms. The degree of permanent quaternization may be from 0% to about 30% of the polyethyleneimine backbone nitrogen atoms. It is preferred to have less than 30% of the polyethyleneimine backbone nitrogen atoms permanently quaternized.

A preferred modified polyethyleneimine has the general structure of formula (I):

formula (I)

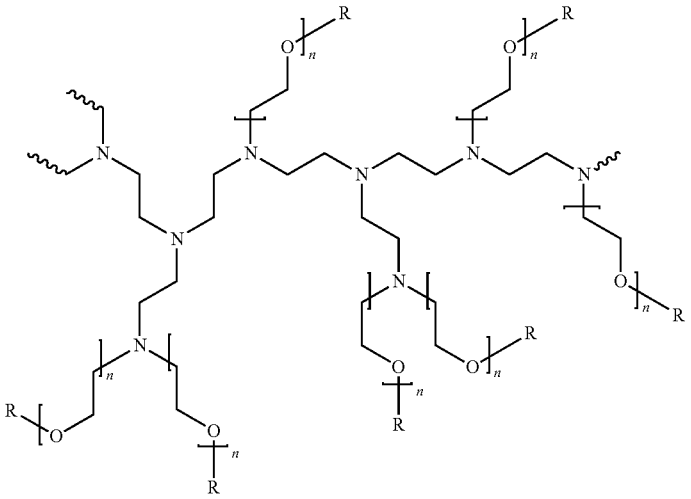

wherein the polyethyleneimine backbone has a weight average molecular weight of 600 or 5000, n of formula (I) has an average of 5-10 and R of formula (1) is selected from hydrogen, a $C_1$-$C_4$ alkyl and mixtures thereof Another preferred polyethyleneimine has the general structure of formula (II).

formula (II)

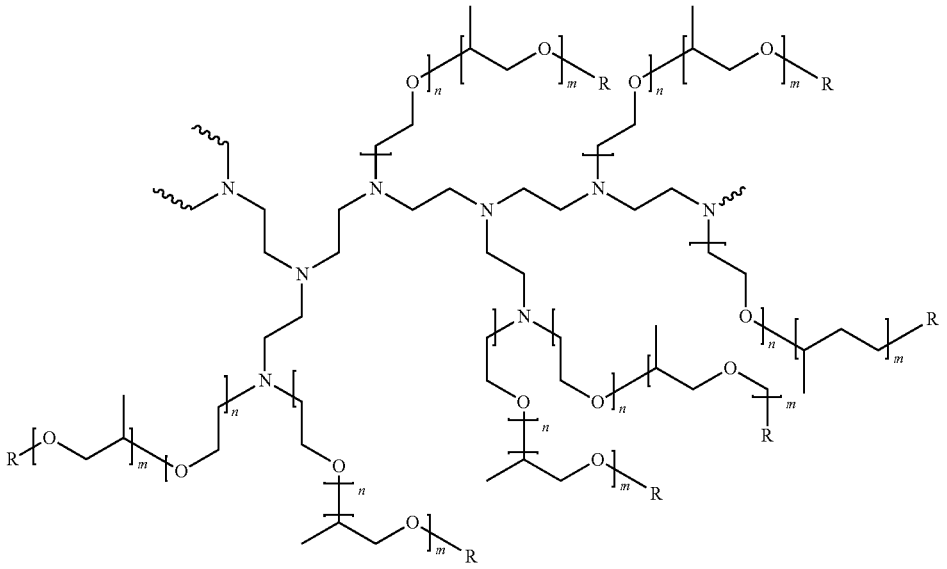

wherein the polyethyleneimine backbone has a weight average molecular weight of either 600 or 5000, n of formula (II) has an average of 10, m of formula (II) has an average of 7 and R of formula (II) is selected from hydrogen, a $C_1$-$C_4$ alkyl and mixtures thereof. The degree of permanent quaternization of formula (II) may be from 0% to about 22% of the polyethyleneimine backbone nitrogen atoms.

These polyamines can be prepared, for example, by polymerizing ethyleneimine in the presence of a catalyst such as carbon dioxide, sodium bisulfite, sulfuric acid, hydrogen peroxide, hydrochloric acid, acetic acid, and the like.

EXAMPLE 1

Polyethyleneimine (Backbone Molecular Weight 5000) Hereinafter PEI 5000 with 7 Exthoxy Moieties (EO) per Nitrogen of the Polyethyleneiminie Backbone (NH)

a) Treatment of PEI 5000 with 1 EO/NH

Heat to 80° C. in a 2 L reactor 900 g of a 50 wt % aqueous solution of PEI 5000 (backbone molecular weight 5000) and strip with nitrogen thrice (until a pressure of 500 kPa (5 bar) is obtained). Increase the temperature to 90° C. and add 461 g ethylene oxide until pressure rises to 500 kPa (5 bar). Remove the volatile components after 2 hours by stripping with nitrogen at 80° C. or vacuum of 50 kPa (500 mbar) at 80° C. Collect 1345 g of a 68% aqueous solution, which contains PEI 5000 with 1 EO/NH b) Alkoxylation in the Presence of a Solvent Treat in a 2 l reactor 362 g of a 68.5% aqueous solution horn step (a) with 31 g of 40% aqueous solution of potassium hydroxide and 300 g xylene and and strip with nitrogen thrice (until a pressure of 500 kPa (5 bar) is obtained). Remove water during a 4 hour time period at 170° C. (under ascription of solvent). Add 753 g ethylene oxide at 120° C. until pressure of 300 kPa (3 bar) is obtained. Stir for 3 hours at 120° C. Remove the solvent from the compound and strip with a water steam at 120° C. for 3 hours. Collect 1000 g of a bright brownish viscous liquid (amine: 2.5448 mmol KOH/g; pH value 1% ig in water 11.2), which is the desired product (PEI 5000-7 EO/NH).

EXAMPLE 2

Polyethyleneimine (Backbone Molecular Weight 5000) Hereinafter PEI 5000 with 10 Exthoxy Moieties (EO) and 7 Propoxy Moieties (PO) per Nitrogen of the Polyethyleneiminie Backbone (NH)

a) Treatment of PEI 5000 with 1 EO/NH as in Example 1.

b) Alkoxylation

Treat in a 2 l reactor 163 g of a 68.4% the aqueous solution from step (a) with 13.9 g of 40% an aqueous solution of potassium hydroxide, heat to 70° C. and strip with nitrogen thrice (until a pressure of 500 kPa (5 bar) is obtained). Remove water during a 4 hour time period at 120° C. and vacuum of 1 kPa (10 mbar). Add 506 g ethylene oxide at 120° C. until pressure of 800 kPa (8 bar) is obtained. Stir for 4 hours at 120° C. Strip with nitrogent 120° C. Add 519 g propylene oxide at 120° C. until pressure of 800 kPa (8 bar) is obtained. Stir for 4 hours at 102° C. Remove volatile components by stripping with nitrogen at 80° C. or vacuum of 50 kPa (500 mbar) at 80° C. Collect 1178 g of a bright brownish viscous liquid (amine titer: 0.9276 mmol KOH/g; pH value 1% ig in water 10.67), which is the desired product (PEI 5000-10 EO/NH-7 PO/NH).

OR

Alternative b) Alkoxylation in the Presence of a Solvent

Treat in a 2 l reactor 137 g of a 68.7% the aqueous solution from (a) with 11.8 g of 40% aqueous solution of potassium hydroxide and 300 g xylene and strip with nitrogen thrice (until pressure of 500 kPa (5 bar)). Remove the water present over the next 4 hours while maintaining a temperature of 170°

C. (under ascription of solvent). Add 428 g of ethylene oxide at 120° C. until pressure of 300 kPa (3 bar) is obtained and stir for 2 hours at 120° C. Strip with nitrogen at 120° C. Add 439 g propylene oxide at 120° C. until pressure of 300 kPa (3 bar) is obtained. Stir for 3 hours at 120° C. Remove the solvent from the compound and strip with a water steam at 120° C. for 3 hours. Collect 956 g of a bright brownish viscous liquid (amine titer: 0.9672 mmol KOH/g; pH value 1 % ig in water 10.69), which is the desired product (PEI 5000-10 EO/NH-7 PO/NH).

EXAMPLE 3

Polyethyleneimine (Backbone Molecular Weight 5000) Hereinafter PEI5000 with 10 Exthoxy Moieties (EO) and 7 Propoxy Moieties (PO) per Nitrogen of the Polyethyleneiminie Backbone (NH) with 22% Quaternization Prepare PEI 5000 EO10 PO7 as Shown in the Example 2 a) Quaternization 300 g of PEI5000-10 EO/NH-7 PO/NH (example 2) under nitrogen atmosphere were heated to 60° C. Subsequent 7.3 g dimethyl sulfate were dropwise added. Temperature rose to 70° C. and the mixture was stirred for 3 h. Reduction of amine titer (from 0.9672 mmol/g to 0.7514 mmol/g) showed a quaternation of 22% of N. 307 g of a brownish, viscous liquid are received, which is PEI 5000-(10 EO-7 PO)/NH-22% quatted.

EXAMPLE 4

Polyethyleneimine (Backbone Molecular Weight 600) Hereinafter PEI600 with 10 Exthoxy Moieties (EO) and 7 Propoxy Moieties (PO) per Nitrogen of the Polyethyleneiminie Backbone (NH)

a) Treatment of PEI 600 with 1 EO/NH

In a 2 l reactor 516 g of polyethylene imine 600 (molecular weight 600 g/mol) and 10.3 g water were stripped with nitrogen thrice (until pressure of 5 bar) and heated to 90° C. At 90° C. 528 g ethylene oxide were added. After 1 h stirring at 90° C. 1050 g of a liquid are received. Volatile components arc removed by stripping with nitrogen or vacuum of 10 mbar at 90° C. The liquid contains PEI 600 with 1 EO/NH.

b) Alkoxylation

In a 2 l reactor 86 g of a liquid from a) were treated with 10.8 g of 40% aqueous solution of KOH, heated to 80° C. and stripped with nitrogen thrice (until pressure of 5 bar). Water was removed during 2.5 h at 120° C. and vacuum of 10 mbar. Subsequent reactor was flushed with nitrogen and 384 g ethylene oxide were added at 120° C. and 2 h stirred at this temperature afterwards. Afterwards at 120° C. 393 g propylene oxide were added at 120° C. and 2 h stirred at this temperature. Volatile components are removed by stripping with nitrogen or vacuum of 500 mbar at 80° C. 865 g of a bright brownish viscous liquid are received (amine titer: 1.0137 mmol/g; pH value 1% ig in water 11.15), which is the desired product (PEI 600-10 EO/NH-7 PO/NH).

2) pH of the Composition

As a second essential element of the present invention, the liquid detergent composition will have a pH measured as a 10% solution (in distilled water) comprised between 7.5 and 8.4, preferably pH 7.7 to 8.0. The pH of the composition can be adjusted using pH modifying ingredients known in the art of acid-base trimming.

3) The Amine Oxide Surfactant

The liquid detergent composition herein comprises from 0.1% to 15%, preferably from 2.0% to 10%, more preferably 4.0% to 8.0% by weight of the liquid detergent composition of an amine oxide surfactant. The amine oxide may have a linear or mid-branched alkyl moiety.

Linear amine oxides, include water-soluble amine oxides containing one $C_{8-18}$ alkyl moiety and 2 moieties selected from the group consisting of $C_{1-3}$ alkyl groups and $C_{1-3}$ hydroxyalkyl groups.

Preferred amine oxide surfactants have formula (VI):

$$R^3(OR^4)_xN^{\rightarrow O}(R^5)_2 \quad \text{(VI)}$$

wherein $R^3$ of formula (VI) is an linear $C_{8-22}$ alkyl, linear $C_{8-22}$ hydroxyalkyl, $C_{8-22}$ alkyl phenyl group, and mixtures thereof; $R^4$ of formula (VI) is an $C_{2-3}$ alkylene or $C_{2-3}$ hydroxyalkylene group or mixtures thereof; x is from 0 to about 3; and each $R^5$ of formula (VI) is an $C_{1-3}$ alkyl or $C_{1-3}$ hydroxyalkyl group or a polyethylene oxide group containing an average of from about 1 to about 3 ethylene oxide groups. The $R^5$ groups of formula (VI) may be attached to each other, e.g., through an oxygen or nitrogen atom, to form a ring structure.

The linear amine oxide surfactants in particular may include linear $C_{10}$-$C_{18}$ alkyl dimethyl amine oxides and linear $C_8$-$C_{12}$ alkoxy ethyl dihydroxy ethyl amine oxides. Preferred amine oxides are alkyl dimethyl amine oxides and include linear $C_{10}$, linear $C_{10}$-$C_{12}$, and linear $C_{12}$-$C_{14}$ alkyl dimethyl amine oxides, more preferred $C_{10}$-$C_{18}$ alkyl dimethyl amine oxide or mixtures thereof.

As used herein "mid-branched" means that the amine oxide has one alkyl moiety having $n_1$ carbon atoms with one alkyl branch on the alkyl moiety having $n_2$ carbon atoms. The alkyl branch is located on the $\alpha$ carbon from the nitrogen on the alkyl moiety. This type of branching for the amine oxide is also known in the art as an internal amine oxide. The total sum of $n_1$ and $n_2$ is from 10 to 24 carbon atoms, preferably from 12 to 20, and more preferably from 10 to 16. The number of carbon atoms for the one alkyl moiety ($n_1$) should be approximately the same number of carbon atoms as the one alkyl branch ($n_2$) such that the one alkyl moiety and the one alkyl branch are symmetric. As used herein "symmetric" means that $|n_1-n_2|$ is less than or equal to 5, preferably 4, most preferably from 0 to 4 carbon atoms in at least 50 wt %, more preferably at least 75 wt % to 100 wt % of the mid-branched amine oxides for use herein.

The amine oxide can further comprise two moieties, independently selected from a $C_{1-3}$ alkyl, a $C_{1-3}$ hydroxyalkyl group, or a polyethylene oxide group containing an average of from 1 to 3 ethylene oxide groups. Preferably the two moieties are selected from a $C_{1-3}$ alkyl, more preferably both are selected as a $C_1$ alkyl.

4) Alkyl Ethoxylated Sulfate Surfactants

The composition of the present invention will comprise from 5% to 40% by weight of the composition of one or more alkyl ethoxylated sulfate surfactant(s), potentially with one or more alkyl sulfate surfactant(s); wherein the overall average ethoxylation degree for these sulfate surfactant(s) is below or equal to 2 [≦2], preferably below or equal to 1 [≦1]. By overall average ethoxylation degree it is meant the average ethoxylation degree delivered by the sum of all alkyl ethoxylated sulfate(s) and alkyl sulfate(s) present in the composition.

Those sulfate surfactant(s) are present at a level of from 5% to 40% and preferably from 15% to 30%, more preferably at 15% to 25% by weight of the liquid detergent composition.

Suitable sulfate surfactant(s) for use herein include water-soluble salts or acids of $C_{10}$-$C_{18}$, preferably $C_{12}$-$C_{14}$ alkyl or hydroxyalkyl sulphate. Suitable counterions include hydrogen, alkali metal cation or ammonium or substituted ammonium, but preferably sodium.

Preferably, the hydrocarbyl chain is branched, more preferably it comprises $C_{1-4}$ alkyl branching units, typically at the $C_2$ position. The average percentage branching of those sulfate surfactant(s) is preferably greater than 30%, more preferably from 20% to 60% and most preferably from 30% to 55% of the total hydrocarbyl chains.

Those sulphate surfactant(s) may be selected from $C_8$-$C_{20}$ primary, branched-chain and random alkyl sulphates (AS); $C_{10}$-$C_{18}$ secondary (2,3)alkyl sulfates; $C_{10}$-$C_{15}$ alkyl alkoxy sulfates ($AE_xS$); $C_{10}$-$C_{18}$ alkyl alkoxy carboxylates preferably comprising 1-5 ethoxy units: mid-chain branched alkyl sulphates as discussed in U.S. Pat. Nos. 6,020,303 and 6,060,443; mid-chain branched alkyl alkoxy sulphates as discussed in U.S. Pat. Nos. 6,008,181 and 6,020,303.

Aqueous Liquid Carrier

The liquid detergent compositions herein further contain from 30% to 80% of an aqueous liquid carrier in which the other essential and optional compositions components are dissolved, dispersed or suspended. More preferably the aqueous liquid carrier will comprise from 45% to 70%, more preferable from 45% to 65% of the compositions herein.

One preferred component of the aqueous liquid carrier is water. The aqueous liquid carrier, however, may contain other materials which are liquid, or which dissolve in the liquid carrier, at room temperature (20° C.-25° C.) and which may also serve some other function besides that of an inert filler. Such materials can include, for example, hydrotropes and solvents, discussed in more detail below. Dependent on the geography of use of the liquid detergent composition of the present invention, the water in the aqueous liquid carrier can have a hardness level of about 2-30 gpg ("gpg" is a measure of water hardness that is well known to those skilled in the art, and it stands for "grains per gallon").

Thickness of the Composition

The liquid detergent compositions of the present invention are preferably thickened and have viscosity of greater than 50 cps, when measured at 20° C. More preferably the viscosity of the composition is between 75 and 200 cps.

Surfactants

The liquid detergent composition of the present invention may further comprise surfactants other than those discussed above, and are selected from nonionic, other anionic, zwitterionic, semi-polar nonionic surfactants, and mixtures thereof. The surfactants of the present invention together with the optional surfactants, when present, may comprises from 1% to 50% by weight, preferably from 5% to 40% by weight, more preferably 25% to 40% and even more preferably from 30% to 38% by weight, of the liquid detergent composition. Non-limiting examples of optional surfactants are discussed below.

Other Anionic Surfactants:

Other suitable anionic surfactants that can be present in the composition of the present invention are the sulphonate surfactants. The total amount of sulphate or sulphonate surfactant within the composition of the present invention is generally present at a level of at least 5%, preferably from 5% to 40% and more preferably from 15% to 30%, even more preferably at 15% to 25% by weight of the liquid detergent composition.

Suitable sulphonate surfactants for use in the compositions herein include water-soluble salts or acids of $C_{10}$-$C_{14}$ alkyl or hydroxyalkyl sulphonates. Suitable counterions include hydrogen, alkali metal cation or ammonium or substituted ammonium, but preferably sodium. The sulphonate surfactants may be selected from $C_{11}$-$C_{18}$ alkyl benzene sulphonates (LAS); $C_{10}$-$C_{18}$ alkyl alkoxy carboxylates preferably comprising 1-5 ethoxy units; modified alkylbenzene sulphonate (MLAS) as discussed in WO 99/05243, WO 99/05242, WO 99/05244, WO 99/05082, WO 99/05084, WO 99/05241, WO 99/07656, WO 00/23549, and WO 00/23548; methyl ester sulphonate (MES); alpha-olefin sulphonate (AOS and alkyl glyceryl sulphonate surfactants.

Dialkylsulfosuccinates

An optional component may be a $C_{6-15}$ linear or branched dialkyl sulfosuccinate; preferably asymmetrical (i.e., different alkyl moieties) and at a level of 0.5% to 10% by weight of the composition.

Nonionic Surfactants

Nonionic surfactant, when present in the composition, is present in an effective amount, more preferably from 0.1% to 20%, by weight of the liquid detergent composition. Suitable nonionic surfactants include the condensation products of aliphatic alcohols with from 1 to 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from 10 to 20 carbon atoms with from 2 to 18 moles of ethylene oxide per mole of alcohol. Also suitable are alkylpolyglycosides having the formula $R^2O(C_nH_{2n}O)_t(\text{glycosyl})_x$ (formula (III)), wherein $R^2$ of formula (III) is selected from the group consisting of alkyl, alkyl-phenyl, hydroxyalkyl, hydroxyalkylphenyl, and mixtures thereof in which the alkyl groups contain from 10 to 18, preferably from 12 to 14, carbon atoms; n of formula (III) is 2 or 3, preferably 2; t of formula (III) is from 0 to 10, preferably 0; and x of formula (III) is from 1.3 to 10, preferably from 1.3 to 3, most preferably from 1.3 to 2.7. The glycosyl is preferably derived from glucose.

Also suitable are fatty acid amide surfactants having the formula (IV):

$$R^6\overset{\overset{\displaystyle O}{\|}}{C}N(R^7)_2 \qquad \text{(IV)}$$

wherein $R^6$ of formula (IV) is an alkyl group containing from 7 to 21, preferably from 9 to 17, carbon atoms and each $R^7$ of formula (IV) is selected from the group consisting of hydrogen, $C_1$-$C_4$ alkyl, $C_1$-$C_4$ hydroxyalkyl, and $—(C_2H_4O)_xH$ where x of formula (IV) varies from 1 to 3. Preferred amides are $C_8$-$C_{20}$ ammonia amides, monoethanolamides, diethanolamides, and isopropanolamides.

Cationic surfactants, are generally present in amount of 0.1% to 20%, by weight of the liquid detergent composition. Suitable cationic surfactants are quaternary ammonium surfactants. Suitable quaternary ammonium surfactants are selected from the group consisting of mono $C_6$-$C_{16}$, preferably $C_6$-$C_{10}$ N-alkyl or alkenyl ammonium surfactants, wherein the remaining N positions are substituted by methyl, hydroxyehthyl or hydroxypropyl groups. Another preferred cationic surfactant is a $C_6$-$C_{18}$ alkyl or alkenyl ester of a quaternary ammonium alcohol, such as quaternary chlorine esters. More preferably, the cationic surfactants have the formula (V):

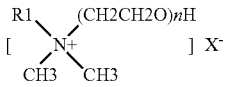

(V)

wherein R1 of formula (V) is $C_8$-$C_{18}$ hydrocarbyl and mixtures thereof, preferably, $C_8$-$C_{14}$ alkyl, more preferably, a $C_8$, $C_{10}$ or $C_{12}$ alkyl, and X of formula (V) is an anion, preferably chloride or bromide.

Ampholytic Surfactants

Other suitable examples of amphoteric detergent surfactants that are optional include amido propyl betaines and derivatives of aliphatic or heterocyclic secondary and ternary amines in which the aliphatic moiety can be straight chain or branched and wherein one of the aliphatic substituents contains from 8 to 24 carbon atoms and at least one aliphatic substituent contains an anionic water-solubilizing group. Typically, when present, ampholytic surfactants comprise from 0.01% to 20%, preferably from 0.5% to 10% by weight of the liquid detergent composition.

Magnesium Ions

The optional presence of magnesium ions may be utilized in the detergent composition when the compositions are used in softened water that contains few divalent ions. When utilized, the magnesium ions preferably are added as a hydroxide, chloride, acetate, sulfate, formate, oxide or nitrate salt to the compositions of the present invention. When included, the magnesium ions are present at an active level of from 0.01% to 4%, preferably from 0.01% to 1.5%, more preferably from 0.015% to 1%, even more preferably from 0.025% to 0.5%, by weight of the liquid detergent composition.

Solvent

The present compositions may optionally comprise a solvent. Suitable solvents include $C_{4-14}$ ethers and diethers, glycols, alkoxylated glycols, $C_6$-$C_{16}$ glycol ethers, alkoxylated aromatic alcohols, aromatic alcohols, aliphatic branched alcohols, alkoxylated aliphatic branched alcohols, alkoxylated linear $C_1$-$C_5$ alcohols, linear $C_1$-$C_5$ alcohols, amines, $C_8$-$C_{14}$ alkyl and cycloalkyl hydrocarbons and halohydrocarbons, and mixtures thereof. When present, the liquid detergent composition will contain from about 0.01% to about 20%, preferably from about 0.5% to about 20%, more preferably from about 1% to about 10% by weight of the liquid detergent composition of a solvent. These solvents may be used in conjunction with an aqueous liquid carrier, such as water, or they may be used without any aqueous liquid carrier being present.

Hydrotrope

The liquid detergent compositions of the invention may optionally comprise a hydrotrope in an effective amount so that the liquid detergent compositions are appropriately compatible in water. Suitable hydrotropes for use herein include anionic-type hydrotropes, particularly sodium, potassium, and ammonium xylene sulfonate, sodium, potassium and ammonium toluene sulfonate, sodium potassium and ammonium cumene sulfonate, and mixtures thereof, and related compounds, as disclosed in U.S. Pat. No. 3,915,903. The liquid detergent compositions of the present invention typically comprise from 0% to 15% by weight of the liquid detergent composition of a hydrotropic, or mixtures thereof, preferably from 1% to 10%, most preferably from 3% to 6% by weight.

Polymeric Suds Stabilizer

The compositions of the present invention may optionally contain a polymeric suds stabilizer. These polymeric suds stabilizers provide extended suds volume and suds duration of the liquid detergent compositions. These polymeric suds stabilizers may be selected from homopolymers of (N,N-dialkylamino)alkyl esters and (N,N-dialkylamino)alkyl acrylate esters. The weight average molecular weight of the polymeric suds boosters, determined via conventional gel permeation chromatography, is from 1,000 to 2,000,000, preferably from 5,000 to 1,000,000, more preferably from 10,000 to 750,000, more preferably from 20,000 to 500,000, even more preferably from 35,000 to 200,000. The polymeric suds stabilizer can optionally be present in the form of a salt, either an inorganic or organic salt, for example the citrate, sulfate, or nitrate salt of (N,N-dimethylamino)alkyl acrylate ester.

One preferred polymeric suds stabilizer is (N,N-dimethylamino)alkyl acrylate esters, namely the acrylate ester represented by the formula (VII):

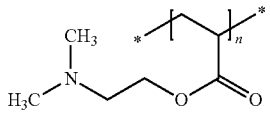

(VII)

When present in the compositions, the polymeric suds booster may be present in the composition from 0.010% to 15%, preferably from 0.05% to 10%, more preferably from 0.1% to 5%, by weight of the liquid detergent composition.

Diamines

Another optional ingredient of the compositions according to the present invention is a diamine. Since the habits and practices of the users of liquid detergent compositions show considerable variation, the composition will preferably contain 0% to 15%, preferably 0.1% to 15% preferably 0.2% to 10%, more preferably 0.25% to 6%, more preferably 0.5% to 1.5% by weight of said composition of at least one diamine.

Preferred organic diamines are those in which pK1 and pK2 are in the range of 8.0 to 11.5, preferably in the range of 8.4 to 11, even more preferably from 8.6 to 10.75. Preferred materials include 1,3-bis(methylamine)-cyclohexane (pKa=10 to 10.5), 1,3 propane diamine (pK1=10.5; pK2=8.8), 1,6 hexane diamine (pK1=11 pK2=10), 1,3 pentane diamine (DYTEK EP®) (pK1=10.5; pK2=8.9), 2-methyl 1,5 pentane diamine (DYTEK A®) (pK1=11.2; pK2=10.0). Other preferred materials include primary/primary diamines with alkylene spacers ranging from $C_4$ to $C_8$. In general, it is believed that primary diamines are preferred over secondary and tertiary diamines.

Definition of pK1 and pK2—As used herein, "pKa1" and "pKa2" are quantities of a type collectively known to those skilled in the art as "pKa" pKa is used herein in the same manner as is commonly known to people skilled in the art of chemistry. Values referenced herein can be obtained from literature, such as from "Critical Stability Constants: Volume 2, Amines" by Smith and Martel, Plenum Press, NY and London, 1975. Additional information on pKa's can be obtained from relevant company literature, such as information supplied by DUPONT®, a supplier of diamines. As a working definition herein, the pKa of the diamines is specified in an all-aqueous solution at 25° C. and for an ionic strength between 0.1 to 0.5 M.

Preferably, the liquid detergent compositions herein are formulated as clear liquid compositions. By "clear" it is meant stable and transparent. In order to achieve clear compositions, the use of solvents and hydrotropes is well known to those familiar with the art of light-duty liquid dishwashing compositions. Preferred liquid detergent compositions in accordance with the invention are clear single phase liquids, but the invention also embraces clear and opaque products containing dispersed phases, such as beads or pearls as described in U.S. Pat. No. 5,866,529, to Erilli, et al., and U.S. Pat. No. 6,380,150, to Toussaint, et al., provided that such products are physically stable (i.e., do not separate) on storage.

The liquid detergent compositions of the present invention may be packages in any suitable packaging for delivering the liquid detergent composition for use. Preferably the package is a clear package made of glass or plastic.

Other Optional Components:

The liquid detergent compositions herein can further comprise a number of other optional ingredients suitable for use in liquid detergent compositions such as carboxylic acid, suds booster, perfume, dyes, opacifiers, enzymes, chelants, thickening agents and pH buffering means so that the liquid detergent compositions herein generally have a pH of from 4 to 14, preferably 6 to 13, most preferably 6 to 10. A further discussion of acceptable optional ingredients suitable for use in light-duty liquid detergent composition may be found in U.S. Pat. No. 5,798,505.

Method of Use

In the method aspect of this invention, soiled dishes are contacted with an effective amount, typically from about 0.5 ml. to about 20 ml. (per 25 dishes being treated), preferably from about 3 ml. to about 10 ml., of the liquid detergent composition of the present invention diluted in water. The actual amount of liquid detergent composition used will be based on the judgment of user, and will typically depend upon factors such as the particular product formulation of the composition, including the concentration of active ingredients in the composition, the number of soiled dishes to be cleaned, the degree of soiling on the dishes, and the like. The particular product formulation, in turn, will depend upon a number of factors, such as the intended market (i.e., U.S., Europe, Japan, etc.) for the composition product. Suitable examples may be seen below in Table 1.

Generally, from about 0.01 ml. to about 150 ml., preferably from about 3 ml. to about 40 ml. of a liquid detergent composition of the invention is combined with from about 2000 ml. to about 20000 ml., more typically from about 5000 ml. to about 15000 ml. of water in a sink having a volumetric capacity in the range of from about 1000 ml. to about 20000 ml., more typically from about 5000 ml. to about 15000 ml. The soiled dishes are immersed in the sink containing the diluted compositions then obtained, where contacting the soiled surface of the dish with a cloth, sponge, or similar article cleans them. The cloth, sponge, or similar article may be immersed in the detergent composition and water mixture prior to being contacted with the dish surface, and is typically contacted with the dish surface for a period of time ranged from about 1 to about 10 seconds, although the actual time will vary with each application and user. The contacting of cloth, sponge, or similar article to the dish surface is preferably accompanied by a concurrent scrubbing of the dish surface.

Another method of use will comprise immersing the soiled dishes into a water bath or held under running water without any liquid dishwashing detergent. A device for absorbing liquid dishwashing detergent, such as a sponge, is placed directly into a separate quantity of undiluted liquid dishwashing composition for a period of time typically ranging from about 1 to about 5 seconds. The absorbing device, and consequently the undiluted liquid dishwashing composition, is then contacted individually to the surface of each of the soiled dishes to remove said soiling. The absorbing device is typically contacted with each dish surface for a period of time range from about 1 to about 10 seconds, although the actual time of application will be dependent upon factors such as the degree of soiling of the dish. The contacting of the absorbing device to the dish surface is preferably accompanied by concurrent scrubbing.

EXAMPLES

Formulations Table I - Light-Duty Liquid Dishwashing Detergent Composition

| Composition | A | B | C | D | E | F |
|---|---|---|---|---|---|---|
| $C_{12-13}$ Alkyl sulfate | 16.8 | 14.4 | — | — | — | — |
| $C_{12-14}$ AE3S[1] | 7.2 | — | — | — | — | — |
| $C_{12-13}$ AE2S[1] | — | 9.6 | — | — | — | — |
| $C_{12-13}$ AE0.6S[1] | — | — | 24.0 | 20.0 | 24.0 | 22.0 |
| $C_{10-14}$ Amine Oxide | 7.0 | 7.0 | 7.0 | 7.0 | 6.0 | 5.0 |
| $C_{11}E_9$ Nonionic[2] | 6.0 | 6.0 | 4.0 | 6.0 | 6.0 | 4.0 |
| Solvents including Ethanol, and Sodium Culmene Sulfonate | 9.0 | 9.0 | 9.0 | 9.0 | 9.0 | 8.0 |
| Alkoxylated polyethyleneimine polymer[4] | 1.0 | 1.0 | 1.0 | 1.0 | 1.0 | 0.8 |
| 1,3 BAC Diamine[5] | 0.5 | 0.5 | 0.5 | 0.5 | 0.5 | 0.2 |
| Suds boosting polymer[6] | — | 0.1 | — | — | — | — |
| pH in a 10% dilution | 7.8 | 7.8 | 7.9 | 7.8 | 7.9 | 7.6 |
| Water | Balance | Balance | Balance | Balance | Balance | Balance |

[1] $C_{12-13(14)}$ alkyl ethoxy sulfate containing an average of 3/2/0.6 ethoxy groups.

[2] Nonionic may be either $C_{11}$ Alkyl ethoxylated surfactant containing 9 ethoxy groups or $C_{10}$ Alkyl ethoxylated surfactant containing 8 ethoxy groups.

[4] Such as the ones exemplified in Examples 1-4 above

[5] 1,3, BAC is 1,3 bis(methylamine)-cyclohexane.

[6] (N,N-dimethylamino)ethyl methacrylate homopolymer

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "440 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition of the same term in a document incorporated by reference, the meaning of definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid dishwashing detergent composition having a pH 10% dilution comprised between about 7.5 and about 8.4, and comprising:

a) from about 0.01% to about 10% by weight of the composition of an alkoxylated polyethyleneimine polymer comprising a polyethyleneimine backbone having from about 400 to about 10000 weight average molecular weight and the alkoxylated polyethyleneimine polymer further comprises:

(1) one or two alkoxylation modifications per nitrogen atom by a polyalkoxylene chain having an average of about 1 to about 30 alkoxy moieties per modification, wherein the terminal alkoxy moiety of the alkoxylation modification is capped with hydrogen, a $C_1$-$C_4$ alkyl or mixtures thereof;

(2) a substitution of one $C_1$-$C_4$ alkyl moiety and one or two alkoxylation modifications per nitrogen atom by a polyalkoxylene chain having an average of about 1 to about 40 alkoxy moieties per modification wherein the terminal alkoxy moiety is capped with hydrogen, a $C_1$-$C_4$ alkyl or mixtures thereof; or (3) a combination thereof; and wherein the alkoxylation modifications of the alkoxylated polyethyleneimine polymer, are ethoxy/1,2 propoxy block moieties and ethoxy/1,3 propoxy block moieties having an average degree of ethoxylation from about 5 to about 15 and an average degree of propoxylation from about 1 to about 16;

b) from about 0.1% to about 15% by weight of the composition of an amine oxide surfactant;

c) from about 15% to about 30% by weight of the composition of an alkyl sulfate surfactant selected from the group consisting of at least an alkyl ethoxylated sulfate surfactant, potentially an alkyl sulfate surfactant, and mixtures thereof; wherein the overall average ethoxylation degree for these alkyl sulfate surfactants is below or equal to 2;

d) a suds boosting polymer; and e) from about 0.1% to about 15% of an organic diamine with a pK1 and a pK2 in the range of about 8.0 to about 11.5, wherein the liquid dishwashing detergent composition is adapted for application onto a dish.

2. The liquid detergent composition according to claim 1 wherein the pH is from 7.5 to below 8.0.

3. The liquid detergent composition according to claim 1 wherein the average degree of ethoxylation is about 10 and the average degree of propoxylation is about 7.

4. The liquid detergent composition according to claim 3 wherein the pH is from 7.5 to below 8.0.

5. The liquid detergent composition according claim 1 wherein the alkoxylated polyethyleneimine polymer is comprised at a level of from about 0.1% to about 5% by weight to the composition.

6. The liquid detergent composition according claim 1 wherein the amine oxide is comprised at a level of from about 2% to about 10% by weight to the composition.

7. The liquid detergent composition according to claim 1 wherein the alkyl sulfate surfactant is comprised at a level of from about 15% to about 30% by weight to the composition.

8. The liquid detergent composition according to claim 1 wherein the amine oxide is an alkyl dimethyl amine oxide.

9. The liquid detergent composition according to claim 8 wherein said alkyl dimethyl amine oxide is a $C_{10}$-$C_{18}$ alkyl dimethyl amine oxide.

10. The liquid detergent composition according to claim 1 wherein the alkyl sulfate surfactant is branched.

11. The liquid detergent composition according to claim 10 wherein average percentage branching of the sulphate surfactant of from 20% to 60% of the total hydrocarbyl chains.

12. The liquid detergent composition according to claim 1 wherein the average ethoxylation degree for the alkyl sulfate surfactants is below or equal to 1.

13. A method of washing dishes with the liquid detergent composition according to claim 1, wherein about 0.01 ml to about 150 ml of said liquid detergent composition is diluted in about 2000 ml to about 20000 ml water, and the dishes are immersed in the diluted composition thus obtained and cleaned by contacting the soiled surface of the dish with a cloth, a sponge or a similar article.

14. A method of washing dishes with the liquid detergent composition according to claim 1, wherein the dishes are immersed in a water bath or held under running water and an effective amount of a liquid detergent composition is absorbed onto a device, and the device with the absorbed liquid detergent composition is contacted individually to the surface of each of the soiled dishes.

* * * * *